US009163303B2

(12) United States Patent
Genma et al.

(10) Patent No.: US 9,163,303 B2
(45) Date of Patent: Oct. 20, 2015

(54) AUSTENITIC HEAT-RESISTANT CAST STEEL

(75) Inventors: Yoshikazu Genma, Toyota (JP); Go Kuramoto, Aichi-ken (JP); Zhong-zhi Zhang, Kariya (JP)

(73) Assignees: TOYOTA JIDOSHA KABUSHIKI KAISHA, Aichi-ken (JP); AISIN TAKAOKA CO., LTD., Aichi-ken (JP)

( * ) Notice: Subject to any disclaimer, the term of this patent is extended or adjusted under 35 U.S.C. 154(b) by 272 days.

(21) Appl. No.: 13/638,990

(22) PCT Filed: Apr. 5, 2011

(86) PCT No.: PCT/IB2011/000740

§ 371 (c)(1),
(2), (4) Date: Oct. 2, 2012

(87) PCT Pub. No.: WO2011/124970

PCT Pub. Date: Oct. 13, 2011

(65) Prior Publication Data

US 2013/0022488 A1 Jan. 24, 2013

(30) Foreign Application Priority Data

Apr. 7, 2010 (JP) ..... 2010-088629

(51) Int. Cl.

| | |
|---|---|
| ***C22C 38/58*** | (2006.01) |
| ***C22C 38/40*** | (2006.01) |
| ***C22C 38/00*** | (2006.01) |
| ***C22C 38/02*** | (2006.01) |
| ***C22C 38/04*** | (2006.01) |
| ***C22C 38/34*** | (2006.01) |
| ***C22C 38/44*** | (2006.01) |
| ***C22C 38/60*** | (2006.01) |

(52) U.S. Cl.

CPC ..... *C22C 38/001* (2013.01); *C22C 38/02* (2013.01); *C22C 38/04* (2013.01); *C22C 38/34* (2013.01); *C22C 38/40* (2013.01); *C22C 38/44* (2013.01); *C22C 38/58* (2013.01); *C22C 38/60* (2013.01)

(58) Field of Classification Search

None

See application file for complete search history.

(56) References Cited

U.S. PATENT DOCUMENTS 3,969,109 A * 7/1976 Tanczyn ..... 420/40

FOREIGN PATENT DOCUMENTS

| | | |
|---|---|---|
| CN | 101415851 A | 4/2009 |
| EP | 0 613 960 A1 | 9/1994 |

(Continued)

OTHER PUBLICATIONS

International Search Report and Written Opinion of the International Searching Authority for corresponding International Patent Application No. PCT/IB2011/000740 mailed Aug. 4, 2011.

(Continued)

*Primary Examiner* — Deborah Yee

(74) *Attorney, Agent, or Firm* — Sughrue Mion, PLLC

(57) ABSTRACT

An iron (Fe)-based austenitic heat-resistant cast steel includes, based on a total of 100 mass % (indicated below simply as "%"): 0.4 to 0.8% of carbon (C), 3.0% or less of silicon (Si), 0.5 to 2.0% of manganese (Mn), 0.05% or less of phosphorus (P), 0.03 to 0.2% of sulfur (S), 18 to 23% of chromium (Cr), 3.0 to 8.0% of nickel (Ni) and 0.05 to 0.4% of nitrogen (N). A ratio of chromium (Cr) to carbon (C) is in a range of $22.5 \leq Cr/C \leq 57.5$. The cast steel includes one or two or more of vanadium (V), molybdenum (Mo), tungsten (W) and niobium (Nb) in a total amount of less than 0.2%.

4 Claims, 11 Drawing Sheets

(56) References Cited

FOREIGN PATENT DOCUMENTS

| | | | |
|---|---|---|---|
| EP | 0 668 367 | A1 | 8/1995 |
| EP | 0 721 995 | A2 | 7/1996 |
| EP | 1 191 117 | A2 | 3/2002 |
| EP | 1 219 720 | A2 | 7/2002 |
| EP | 1 741 799 | A1 | 1/2007 |
| EP | 2003221 | A1 | 12/2008 |
| JP | 2002-194511 | A | 7/2002 |
| JP | 2003-193205 | A | 7/2003 |
| JP | 2004-269979 | A | 9/2004 |
| JP | 2004-292868 | A | 10/2004 |
| JP | 2005-281869 | A | 10/2005 |
| WO | 2009/104792 | A1 | 8/2009 |

OTHER PUBLICATIONS

Written Opinion of the International Preliminary Examining Authority for corresponding International Patent Application No. PCT/IB2011/000740 mailed Mar. 14, 2012.

* cited by examiner

TENSILE STRENGTH AND ELONGATION

MELT FLOW LENGTH

CARBON CONTENT VERSUS RT ELONGATION

SILICON CONTENT VERSUS RT ELONGATION

MANGANESE CONTENT VERSUS TENSILE STRENGTH (950°C)

SULFUR CONTENT VERSUS THERMAL FATIGUE LIFE (950°C)

PHOSPHORUS CONTENT VERSUS RT ELONGATION

CHROMIUM CONTENT VERSUS TENSILE STRENGTH AT 950°C

CHROMIUM CONTENT VERSUS TENSILE STRENGTH AT 950°C

NITROGEN CONTENT VERSUS TENSILE STRENGTH AT 950°C

AMOUNT OF NITROGEN ADDED VERSUS YIELD

THERMAL FATIGUE LIFE (200↔950°C, CONSTRAINT RATIO: 100%)

AUSTENITIC HEAT-RESISTANT CAST STEEL

BACKGROUND OF THE INVENTION

1. Field of the Invention

The invention relates to austenitic heat-resistant cast steels, and more particularly to austenitic heat-resistant cast steels having excellent thermal fatigue characteristics.

2. Description of the Related Art

In order for austenitic heat-resistant cast steels to have excellent thermal fatigue characteristics at 950° C. or more, for example, they must have excellent high-temperature strength properties and excellent toughness from room temperature to elevated temperatures. Temperature-resistant cast steels for resolving such a challenge are described in Japanese Patent Application Publication No. 2004-269979 (JP-A-2004-269979) and Japanese Patent Application Publication No. 2002-194511 (JP-A-2002-194511). JP-A-2004-269979 discloses temperature-resistant cast steels which, based on a total of 100 mass %, include 0.5 to 1.5% of carbon (C), 0.01 to 2% of silicon (Si), 3 to 20% of manganese (Mn), 0.03 to 0.2% of phosphorus (P), 3 to 20% of nickel (Ni), 10 to 25% of chromium (Cr), 0.5 to 4% of niobium (Nb) and 0.1% or less of aluminum (Al), and which also include a total of 1.5 to 6% of one or both of molybdenum (Mo) and tungsten (W), with the balance being primarily iron (Fe).

In iron-based austenitic heat-resistant cast steels, carbon is effective for increasing high-temperature strength and improving castability, and acts as an austenite phase-stabilizing element. Chromium is effective for improving the high-temperature strength, but lowers the toughness when added in a large amount. Moreover, the presence of nickel together with chromium helps increase the high-temperature strength, stabilizing the austenite phase. In light of the above, among iron-based austenitic heat-resistant cast steels according to the related art, use is frequently made of steels containing about 0.3 to 0.8% of carbon, about 10 to 25% of chromium and about 10 to 21% of nickel. In the Japanese industrial Standards (JIS), such steels are designated as, for example, SCH12 and SCH22.

In recent years, nickel has become an increasingly scarce element, in addition to which the cost has skyrocketed. For these reasons, even in austenitic heat-resistant cast steels, the tendency has been to seek lower nickel levels. However, at a low nickel content, the matrix structure is unable to achieve a uniform austenite phase, as a result of which the high-temperature strength decreases. Hence, it is not easy to lower the nickel level while maintaining high-temperature strength characteristics. Adding elements such as vanadium, molybdenum, tungsten and niobium is effective for enhancing the strength. However, these elements have a tendency to lower the toughness, thus making it difficult to achieve both high-temperature strength and toughness.

SUMMARY OF THE INVENTION

The invention relates to an austenitic heat-resistant cast steel which is able to achieve a stable austenite phase at a lower nickel level, thereby enabling the steel to be endowed with both high-temperature strength and toughness.

An aspect of the invention relates to an austenitic heat-resistant cast steel including iron as a base material. This austenitic heat-resistant cast steel includes, based on a total of 100 mass %: 0.4 to 0.8 mass % of carbon; 3.0 mass % or less of silicon; 0.5 to 2.0 mass % of manganese; 0.05 mass % or less of phosphorus; 0.03 to 0.2 mass % of sulfur; 18 to 23 mass % of chromium; 3.0 to 8.0 mass % of nickel; and 0.05 to 0.4 mass % of nitrogen. A ratio of chromium to carbon is 22.5 or more and 57.5 or less.

Because the amount of nickel is in a range of 3.0 to 8.0%, compared with austenitic heat-resistant cast steels currently in common use, this composition enables a low cost austenitic heat-resistant cast steel to be obtained. Although stabilization of the austenite phase was not achieved at a nickel content of about 13% or less in the related art, by adding carbon, manganese and nitrogen in amounts calculated from the nickel equivalent ($Ni_{eq}$=Ni %+0.3 C %+0.5 Mn %+26(N %−0.02)+2.77), an austenitic heat-resistant cast steel having a high strength comparable to or greater than materials according to the related art can be achieved. Moreover, by setting the ratio of chromium to carbon in a range of 22.5≤Cr/C≤57.5, the required solid solubility of chromium in the austenitic matrix structure can be maintained, thus enabling austenitic heat-resistant cast steels which achieve the required high-temperature strength characteristics to be obtained.

The austenitic heat-resistant cast steel according to the present aspect may include less than 0.2 mass % of at least one from among vanadium, molybdenum, tungsten and niobium.

The solid solubility of chromium in the austenitic phase serving as the matrix structure varies according to the amount of carbon. At the same time, including carbide-forming elements (V, Mo, W, Nb) leads to a decline in toughness due to the precipitation of carbide at austenite grain boundaries, and leads to a decline in strength accompanying the decline in chromium solid solubility owing to a decrease in carbon solid solubility within the austenite phase. In the above-indicated composition, by setting the ratio of chromium to carbon in a range of 22.5≤Cr/C≤57.5 and either not including the carbide-forming elements V, Mo, W and Nb or including them but setting the total of one or two or more thereof to less than 0.2%, the above-described decrease in toughness and decrease in strength are resolved.

The austenitic heat-resistant cast steel according to the present aspect may further include less than 0.2 mass % of one from among vanadium, molybdenum, tungsten and niobium.

The austenitic heat-resistant cast steel according to the present aspect may further include 0.19 mass % or less of one from among vanadium and niobium.

The austenitic heat-resistant cast steel according to the present aspect may further include 0.18 mass % or less of one from among molybdenum and tungsten.

According to this invention, a stable austenite phase can be obtained in the matrix structure while at the same time lowering the nickel content, thereby making it possible to obtain austenitic heat-resistant cast steels endowed with both high-temperature strength and toughness.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
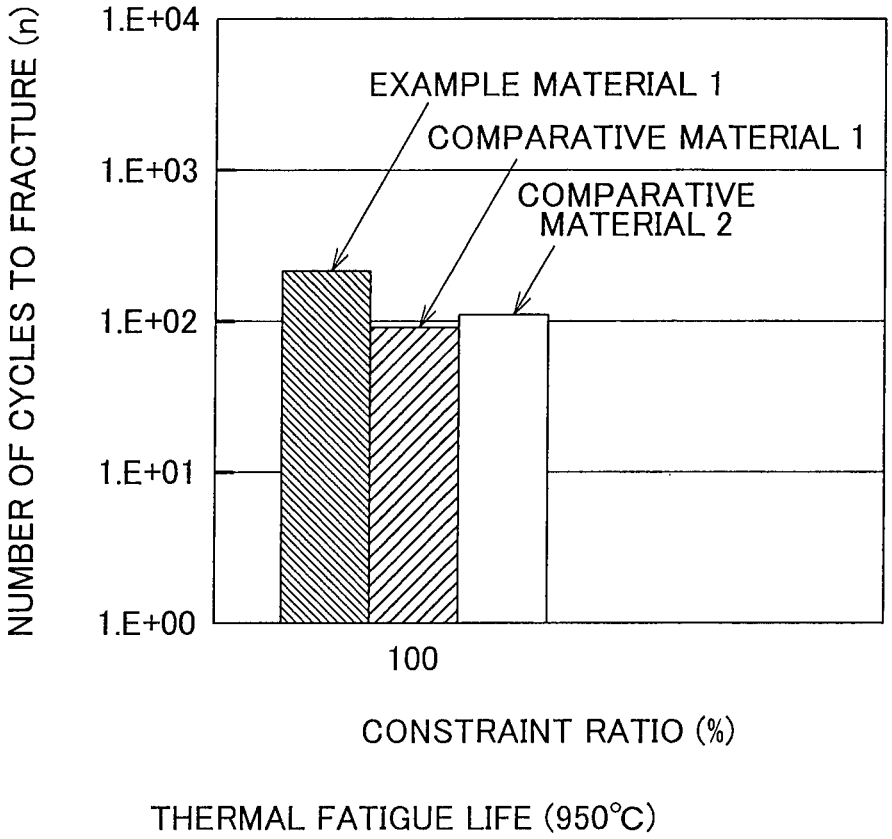
FIG. 1 is a graph showing the results of thermal fatigue tests on example materials and comparative materials.

As a result of intensively conducting numerous experiments and investigations, the inventors have discovered that, in an austenitic heat-resistant cast steel including iron as a base material, (a) by adding specific amounts of the nickel-substituting elements carbon, manganese and nitrogen, it is possible to stabilize the austenite phase even when the amount of nickel addition is decreased, (b) by suitably adding carbon, nitrogen and chromium, it is possible to ensure a good high-temperature strength, and (c) by setting the C—Cr ratio in a suitable range, the solid solubility of chromium in the matrix structure can be ensured, enabling the required high-temperature strength characteristics to be achieved. Moreover, they have also found that (d) by setting the amount of carbide-forming element (V, Mo, W, Nb) addition below a fixed value, a decline in toughness due to carbide precipitation at the austenite grain boundaries can be prevented. The embodiments of the invention are based on the above findings.

One embodiment of the invention relates to an austenitic heat-resistant cast steel which includes iron as a base material. This austenitic heat-resistant cast steel includes, based on a total of 100 mass %: 0.4 to 0.8 mass % of carbon; 3.0 mass % or less of silicon; 0.5 to 2.0 mass % of manganese; 0.05 mass % or less of phosphorus; 0.03 to 0.2 mass % of sulfur; 18 to 23 mass % of chromium; 3.0 to 8.0 mass % of nickel; and 0.05 to 0.4 mass % of nitrogen. A ratio of chromium to carbon is 22.5 or more and 57.5 or less.

The austenitic heat-resistant cast steel according to this embodiment may include less than 0.2 mass % of at least one from among vanadium, molybdenum, tungsten and niobium.

The austenitic heat-resistant cast steel according to this embodiment may further include less than 0.2 mass % of one from among vanadium, molybdenum, tungsten and niobium.

The austenitic heat-resistant cast steel according to this embodiment may further include 0.19 mass % or less of one from among vanadium and niobium.

The austenitic heat-resistant cast steel according to this embodiment may further include 0.18 mass % or less of one from among molybdenum and tungsten.

In the austenitic heat-resistant cast steel according to this embodiment, the reasons for limiting the ranges in the respective ingredients in the above-indicated manner are as follows. Those values are explained more fully in the subsequently described examples.

Carbon acts as an austenite stabilizing element, and also is effective for increasing high-temperature strength and improving castability. However, at less than 0.4%, those effects are limited, and at more than 0.8%, the toughness decreases.

Silicon is effective for improving oxidation resistance and castability, but in excess of 3%, the toughness decreases.

Manganese is an austenite stabilizing element. In this embodiment, because the nickel content has been reduced from about 13% in the related art to 3.0 to 8.0%, based on the above-mentioned nickel equivalent ($Ni_{eq}$=Ni %+0.3 C %+0.5 Mn %+26(N %−0.02)+2.77), it is necessary to add from 0.5 to 2.0% of manganese. At a level in excess of 2%, the tensile strength at 950° C. decreases.

Because adding large amounts of phosphorus and sulfur tends to give rise to heat deterioration with repeated heating and cooling, thus lowering the toughness, the upper limit value for phosphorus was set to 0.05% and the upper limit value for sulfur was set to 0.2%. Sulfur combines with manganese to form MnS compounds, enhancing the machinability, but because this effect is inadequate at less than 0.03%, the lower limit value for sulfur was set to 0.03%.

Chromium is effective for improving the high-temperature strength, but at less than 18%, this effect is inadequate. On the other hand, because the toughness decreases when a large amount of chromium is added, the upper limit for chromium was set to 23%.

Nickel, when present together with chromium, helps improve the high-temperature strength, thereby stabilizing the austenite phase. In iron (Fe)-based austenitic heat-resistant cast steels according to the related art, this effect is inadequate at nickel contents below 13%. However, in this embodiment, as mentioned above, by adding carbon, manganese and nitrogen in amounts calculated from the nickel equivalent ($Ni_{eq}$=Ni %+0.3 C %+0.5 Mn %+26(N %−0.02)+2.77), heat-resistant cast steels having a high-temperature strength equal to or better than materials according to the related art can be achieved with the addition of nickel in a range of 3.0 to 8.0%.

Nitrogen is effective for improving the high-temperature strength and stabilizing the austenite phase, and for achieving a finer microstructure. However, at less than 0.05%, these effects are insufficient. On the other hand, the addition of more than 0.4% of nitrogen excessively lowers the yield and causes gas defects.

Because adding vanadium, molybdenum, tungsten and niobium lowers the toughness of cast steel and lowers the thermal fatigue characteristics under high-constraint conditions, the combined content of these elements is set to less than 0.2%.

The embodiments of the invention are illustrated more fully by way of the following examples and comparative examples.

Example 1

Test materials (Example Material 1, Comparative Materials 1 and 2) for each of the austenitic heat-resistant cast steels having the compositions shown in Table 1 and including iron as a base material were obtained by casting. Casting involved using a 50 kg high-frequency induction furnace to carry out open-air melting, and carrying out deoxidizing treatment with Fe—Si (75 mass %). Comparative Material 1 was a conventional material corresponding to the JIS designation SCH12, and Comparative Material 2 was a conventional material corresponding to the JIS designation SCH22.

Thermal fatigue tests were carried out on Example Material 1 and Comparative Materials 1 and 2. The results are shown in FIG. 1. In this thermal fatigue test, which was conducted with an electrohydraulic servo-type thermal fatigue tester, using a test specimen (gauge distance, 15 mm; gauge diameter, 8 mm), thermal expansion and elongation of the test specimen was carried out by heating from a temperature midway between the upper limit and lower limit temperatures under a 100% constraint ratio (a mechanically completely constrained state), and heating-cooling cycles (lower limit temperature, 200° C.; upper limit temperature, 950° C.) lasting 9 minutes per cycle were repeated. The thermal fatigue characteristics were evaluated based on the number of cycles until the specimen broke completely.

Figure 2:
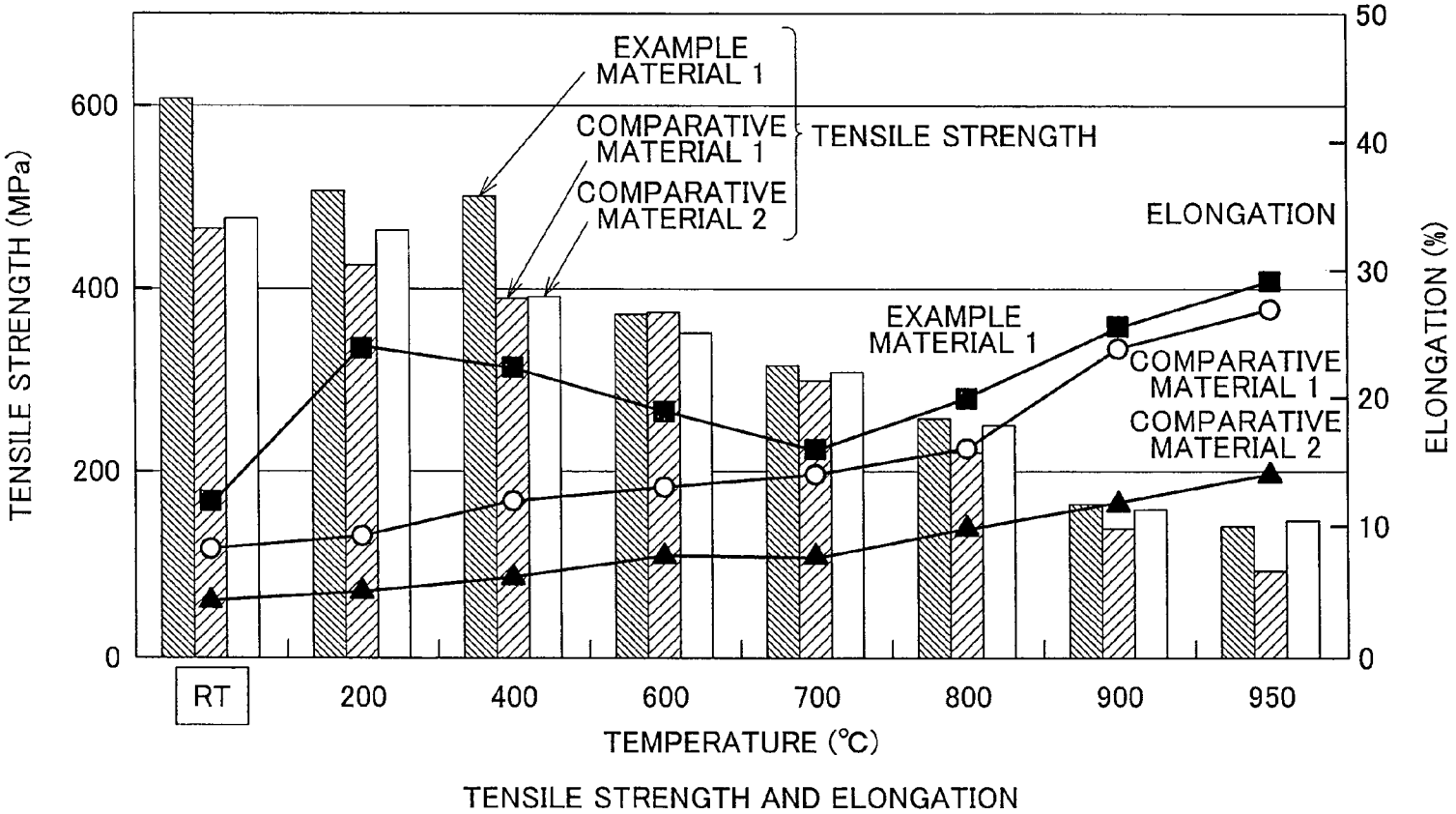
FIG. 2 is a graph showing the results of tensile tests from room temperature to elevated temperatures on example materials and comparative materials.

In addition, tensile tests from room temperature to elevated temperatures were carried out. The tests were carried out in general accordance with JIS Z2241 and JIS G0567 at each of the following temperatures: room temperature, 200° C., 400° C., 600° C., 700° C., 800° C., 900° C. and 950° C. The results are shown in FIG. 2.

TABLE 1

| | C | Si | Mn | P | S | Cr | Ni | N |
|---|---|---|---|---|---|---|---|---|
| Example Material 1 | 0.58 | 2.1 | 1.1 | 0.03 | 0.10 | 20.6 | 6.1 | 0.25 |
| Comparative Material 1 | 0.30 | 1.8 | 1.6 | 0.02 | 0.02 | 21.0 | 10.0 | — |
| Comparative Material 2 | 0.40 | 1.6 | 1.3 | 0.02 | 0.02 | 25.0 | 21.0 | — |

Evaluation

It is apparent from FIG. 1 that, on comparing Example Material 1 with Comparative Materials 1 and 2, Example Material 1 has markedly improved thermal fatigue characteristics. Moreover, from FIG. 2, although Example Material 1 has a lower nickel content than Comparative Materials 1 and 2, it includes the austenite phase stabilizing elements carbon, manganese and nickel in a combined amount of 1.93%; because these elements stabilize the austenite phase, Example Material 1 has a tensile strength higher than that of Comparative Example 1 which contains 10% Ni, and comparable to that of Comparative Example 2 which contains 21% Ni. It is also apparent from FIG. 2 that, on comparing Example Material 1 with Comparative Materials 1 and 2, Example Material 1 has an improved elongation. That is, because Example Material 1 possesses both tensile strength and toughness, it has improved thermal fatigue characteristics.

Example 2

(Cr/C Range and Content Range of Carbide-Forming Elements (V, Mo, W, Nb))

Figure 3:
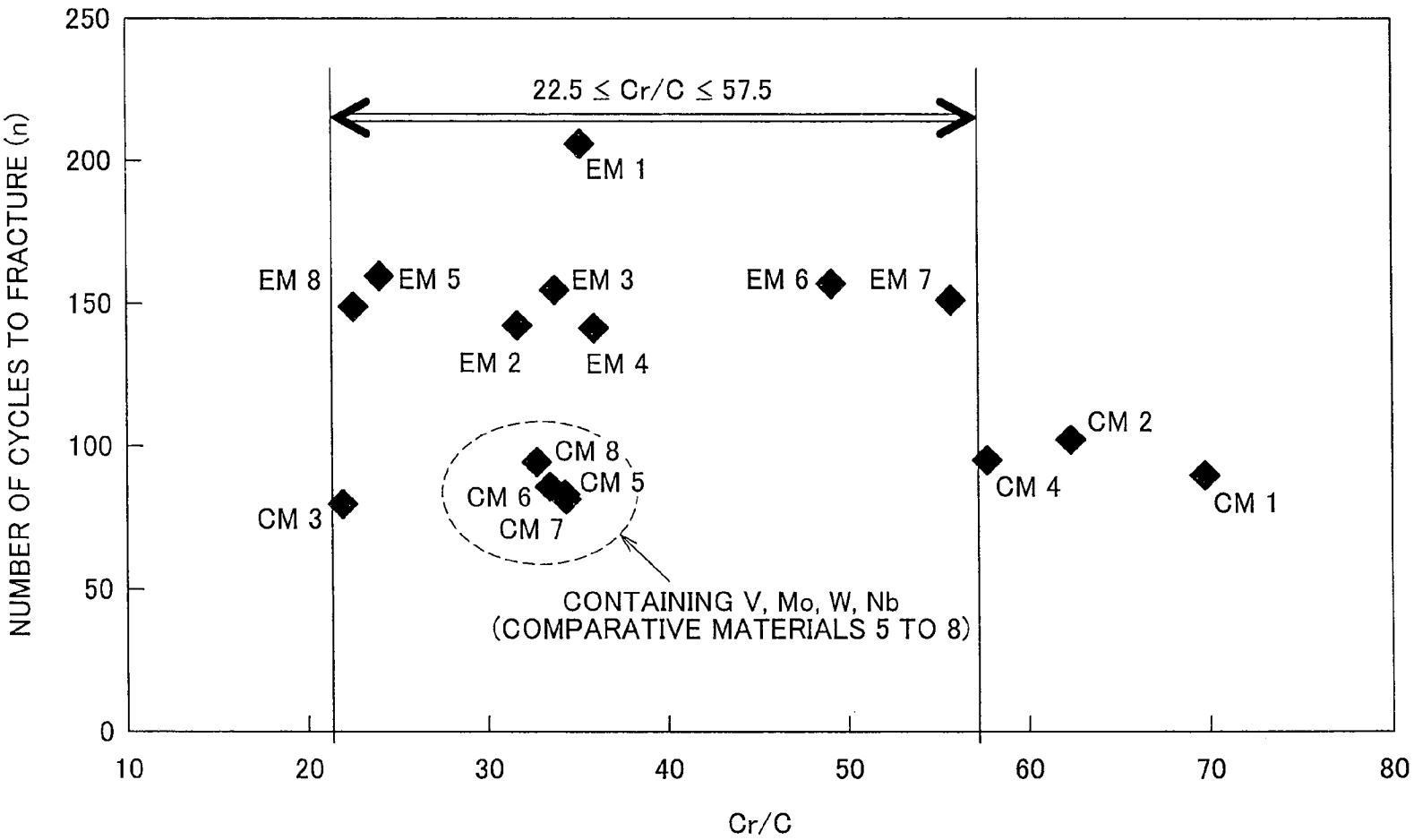
FIG. 3 is a graph plotting the relationship between the Cr/C value and the number of cycles to fracture (n) for test materials of each of the example materials and comparative materials, the Cr/C value being represented on the horizontal axis and the number of cycles to fracture (n) being represented on the vertical axis.

The Cr/C range and the range in content of carbide-forming elements (V, Mo, W, Nb) were verified. Test materials (Example Materials 1 to 8, Comparative Materials 1 to 8) having the compositions shown in Table 2 were obtained by casting in the same way as in Example 1. Thermal fatigue tests were carried out on each of the test materials in the same manner as in Example 1; the number of cycles up to fracture (n) obtained from the tests are shown in Table 2. In addition, FIG. 3 plots, for each test material, the Cr/C value material on the horizontal axis and the number of cycles to fracture (n) on the vertical axis. In FIG. 3, EM 1 to 8 represent Example Materials 1 to 8, and CM 1 to 8 represent Comparative Materials 1 to 8. Also, in Table 2, Example Material 1 and Comparative Materials 1 and 2 are the same test materials as shown in Table 1.

TABLE 2

| | C | Si | Mn | P | S | Cr | Ni | N | Other elements | Cr/C | Cycles to fracture (n) |
|---|---|---|---|---|---|---|---|---|---|---|---|
| Example Material 1 | 0.58 | 2.1 | 1.1 | 0.03 | 0.10 | 20.6 | 6.10 | 0.25 | — | 35.5 | 206 |
| Example Material 2 | 0.60 | 2.1 | 0.50 | 0.03 | 0.05 | 19.2 | 5.10 | 0.40 | — | 32.0 | 143 |
| Example Material 3 | 0.60 | 1.8 | 0.50 | 0.03 | 0.20 | 20.4 | 4.50 | 0.05 | — | 34.0 | 155 |
| Example Material 4 | 0.61 | 2.1 | 0.50 | 0.03 | 0.20 | 22.0 | 5.80 | 0.40 | — | 36.1 | 142 |
| Example Material 5 | 0.78 | 2.1 | 1.5 | 0.03 | 0.05 | 19.0 | 5.60 | 0.05 | — | 24.4 | 160 |
| Example Material 6 | 0.45 | 1.8 | 1.5 | 0.03 | 0.05 | 22.2 | 5.90 | 0.40 | — | 49.3 | 157 |
| Example Material 7 | 0.41 | 2.2 | 1.5 | 0.03 | 0.20 | 22.9 | 5.80 | 0.05 | — | 55.9 | 152 |
| Example Material 8 | 0.79 | 1.9 | 1.5 | 0.03 | 0.20 | 18.1 | 4.20 | 0.40 | — | 22.9 | 150 |
| Comparative Material 1 | 0.30 | 1.8 | 1.6 | 0.02 | 0.02 | 21.0 | 10.0 | — | — | 70.0 | 89 |
| Comparative Material 2 | 0.40 | 1.6 | 1.3 | 0.02 | 0.02 | 25.0 | 21.0 | — | — | 62.5 | 102 |
| Comparative Material 3 | 0.60 | 1.9 | 0.49 | 0.03 | 0.21 | 13.3 | 5.50 | 0.04 | — | 22.2 | 80 |
| Comparative Material 4 | 0.40 | 2.2 | 1.51 | 0.03 | 0.04 | 23.1 | 5.00 | 0.15 | — | 57.8 | 95 |

TABLE 2-continued

| | C | Si | Mn | P | S | Cr | Ni | N | Other elements | Cr/C | Cycles to fracture (n) |
|---|---|---|---|---|---|---|---|---|---|---|---|
| Comparative Material 5 | 0.58 | 1.9 | 1.0 | 0.03 | 0.09 | 20.0 | 5.8 | 0.23 | V: 0.20 | 34.5 | 84 |
| Comparative Material 6 | 0.60 | 1.8 | 1.1 | 0.03 | 0.09 | 20.2 | 6.1 | 0.2 | Mo: 0.20 | 33.7 | 86 |
| Comparative Material 7 | 0.59 | 2.1 | 0.9 | 0.02 | 0.11 | 20.4 | 5.8 | 0.22 | W: 0.20 | 34.6 | 81 |
| Comparative Material 8 | 0.60 | 2.1 | 1.0 | 0.02 | 0.09 | 19.8 | 6.0 | 0.21 | Nb: 0.20 | 33.0 | 95 |

Evaluation

As shown in Table 2 and FIG. 3, Example Materials 1 to 8, for which the Cr/C ratio is in a range of 22.5≤Cr/C≤57.5, had a number of cycles to fracture of 142 or more, which was a large increase over Comparative Materials 1 to 8. It is apparent from this that, compared with Comparative Materials 1 to 8, Example Materials 1 to 8 have markedly improved thermal fatigue characteristics. Although Comparative Examples 5 to 8 have Cr/C ratios in the range of the invention, because they include 0.2% of one of the carbide-forming elements V, Mo, W and Nb, the toughness is decreased, resulting in thermal fatigue characteristics which are inferior to those of the example materials.

Example 3

Carbon Content

Figure 4:
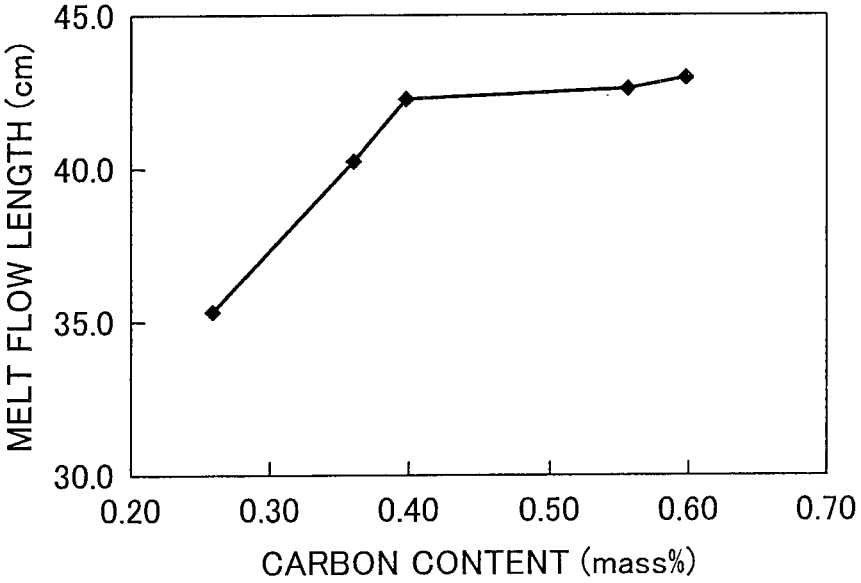
FIG. 4 is a graph showing the relationship between the carbon content and the melt flow length in example materials and comparative materials.

In iron-based austenitic heat-resistant cast steels, carbon is effective at improving the high-temperature strength and improving the castability. Therefore, in this embodiment, tests were carried out to verify that a carbon content of 0.4 to 0.8% is appropriate. Test materials (Example Materials 9 to 11, Comparative Materials 9 and 10) having the compositions shown in Table 3 were obtained by casting in the same manner as in Example 1. For each test material, spiral test pieces with a cross-sectional shape (9×7 mm) for evaluating melt fluidity were cast at a casting temperature of 1500° C. The results are shown in FIG. 4, in which the horizontal axis represents the carbon content and the vertical axis represents the melt flow length.

TABLE 3

| | C | Si | Mn | P | S | Cr | Ni | N |
|---|---|---|---|---|---|---|---|---|
| Comparative Material 9 | 0.26 | 2.1 | 1.0 | 0.03 | 0.08 | 20.4 | 6.0 | 0.23 |
| Comparative Material 10 | 0.36 | 2.0 | 1.1 | 0.04 | 0.10 | 20.5 | 6.2 | 0.25 |
| Example Material 9 | 0.40 | 2.0 | 1.0 | 0.03 | 0.10 | 20.8 | 6.0 | 0.24 |
| Example Material 10 | 0.56 | 1.9 | 1.2 | 0.03 | 0.08 | 21.2 | 5.9 | 0.22 |
| Example Material 11 | 0.60 | 2.0 | 1.0 | 0.03 | 0.08 | 20.2 | 5.8 | 0.28 |

Figure 5:
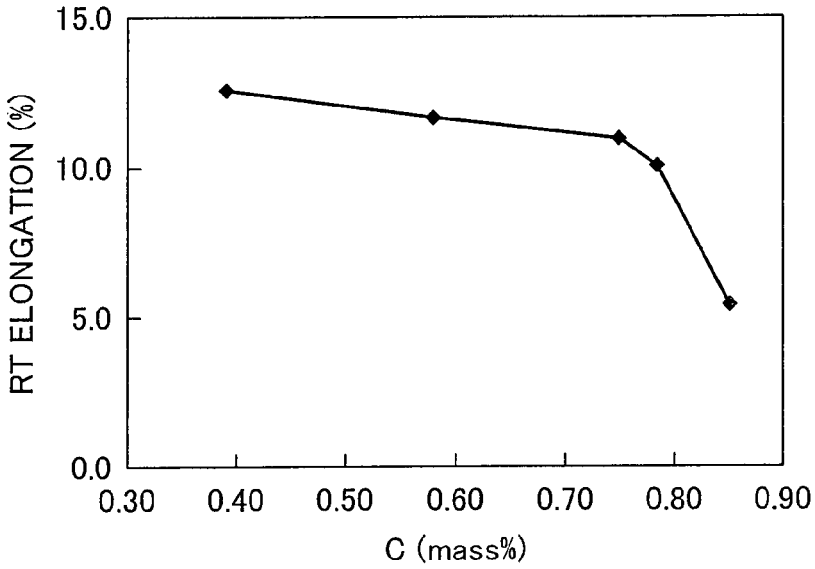
FIG. 5 is a graph showing the relationship between the carbon content and the elongation at room temperature in example materials and comparative materials.

In addition, test materials having the compositions shown in Table 4 (Example Materials 1, 12 and 13, and Comparative Examples 11 and 12) were obtained by casting in the same way as in Example 1. Each of the test materials was subjected to tensile testing at room temperature in general accordance with JIS Z2241. The results are shown in FIG. 5, in which the horizontal axis represents the carbon content and the vertical axis represents elongation (%). In Table 4, Example Material 1 was the same test material as that used in Example 1.

TABLE 4

| | C | Si | Mn | P | S | Cr | Ni | N |
|---|---|---|---|---|---|---|---|---|
| Comparative Material 11 | 0.39 | 2.0 | 1.0 | 0.03 | 0.10 | 20.7 | 6.0 | 0.26 |
| Example Material 1 | 0.58 | 2.1 | 1.1 | 0.03 | 0.10 | 20.6 | 6.1 | 0.25 |
| Example Material 12 | 0.75 | 1.9 | 1.2 | 0.03 | 0.01 | 20.5 | 6.0 | 0.25 |
| Example Material 13 | 0.79 | 2.0 | 1.0 | 0.03 | 0.09 | 21.2 | 5.8 | 0.25 |
| Comparative Material 12 | 0.85 | 2.0 | 1.1 | 0.03 | 0.09 | 21.2 | 5.8 | 0.25 |

Evaluation

As shown in FIG. 4, when the carbon content is less than 0.4%, the melt flow length decreases abruptly, indicating poor castability. Also, as shown in FIG. 5, when the carbon content exceeds 0.8%, the elongation decreases markedly. From these findings, it was verified that, in the present embodiment, a carbon content in a range of 0.4 to 0.8% is appropriate.

Example 4

Silicon Content

Figure 6:
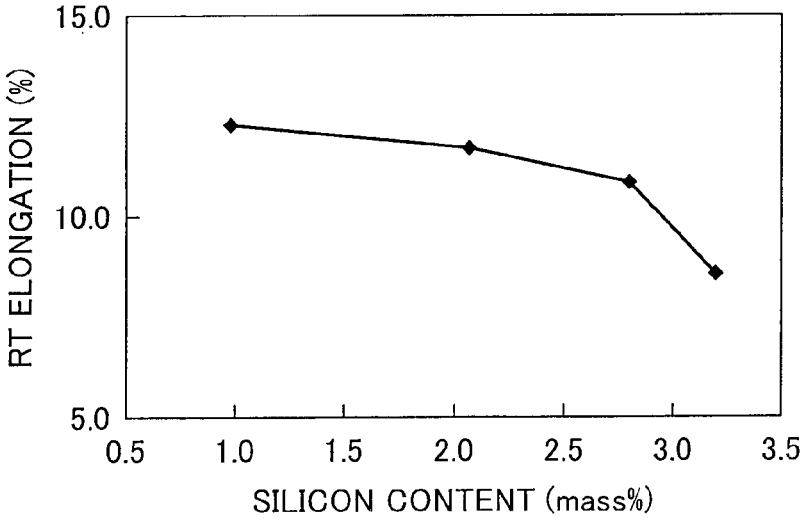
FIG. 6 is a graph showing the relationship between the silicon content and the elongation at room temperature in example materials and comparative materials.

In iron-based austenitic heat-resistant cast steels, silicon is effective for improving oxidation resistance and castability, but the toughness decreases with increasing silicon content. Hence, in this embodiment, verification that a silicon content of 0.3% or less is appropriate was carried out. Test materials (Example Materials 1, 14 and 15, and Comparative Material 13) having the compositions shown in Table 5 were obtained by casting in the same manner as in Example 1. Each of the test materials was subjected to tensile testing at room temperature in general accordance with JIS 22241. The results are shown in FIG. 6, in which the horizontal axis represents the silicon content and the vertical axis represents elongation (%). In Table 5, Example Material 1 was the same test material as that used in Example 1.

TABLE 5

| | C | Si | Mn | P | S | Cr | Ni | N |
|---|---|---|---|---|---|---|---|---|
| Example Material 14 | 0.60 | 1.0 | 1.3 | 0.03 | 0.09 | 20 | 5.8 | 0.23 |
| Example Material 1 | 0.58 | 2.1 | 1.1 | 0.03 | 0.10 | 20.6 | 6.1 | 0.25 |
| Example Material 15 | 0.59 | 2.8 | 1.2 | 0.03 | 0.1 | 20.1 | 6.2 | 0.26 |
| Comparative Material 13 | 0.61 | 3.2 | 1.0 | 0.03 | 0.08 | 20.3 | 6.3 | 0.25 |

Evaluation

As shown in FIG. 6, the elongation decreases as the silicon content increases, and decreases markedly at a silicon content over 3%. From these results, it was verified that, in the present embodiment, a silicon content of 0.3% or less is appropriate.

Example 5

Manganese Content

Figure 7:
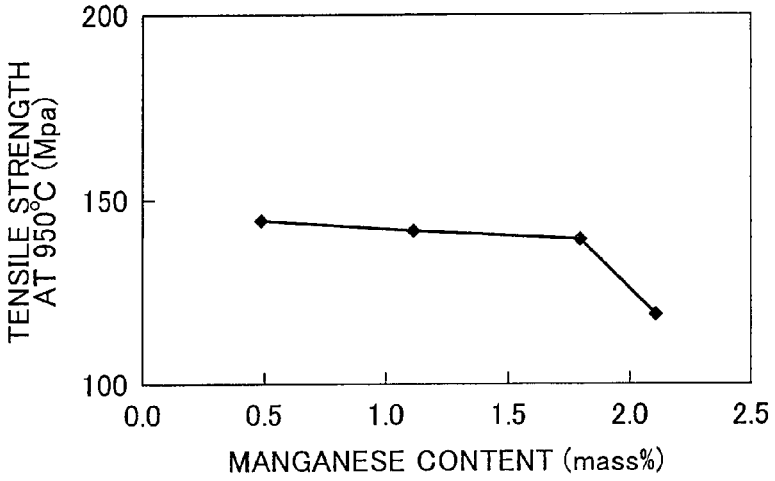
FIG. 7 is a graph showing the relationship between the manganese content and the tensile strength at 950° C. in example materials and comparative materials.

In iron-based austenitic heat-resistant cast steels, manganese functions effectively as an austenite-stabilizing element. However, on exceeding the required amount, manganese lowers the tensile strength. Hence, in this embodiment, verification that a manganese content of less than 2.0% is appropriate was carried out. Test materials (Example Materials 1, 16 and 17, and Comparative Material 14) having the compositions shown in Table 6 were obtained by casting in the same manner as in Example 1. Each of the test materials was subjected to tensile testing at 950° C. in general accordance with JIS G0567. The results are shown in FIG. 7, in which the horizontal axis represents the manganese content and the vertical axis represents the tensile strength at 950° C. (MPa). In Table 6, Example Material I was the same test material as that used in Example 1.

TABLE 6

| | C | Si | Mn | P | S | Cr | Ni | N |
|---|---|---|---|---|---|---|---|---|
| Example Material 16 | 0.58 | 2.0 | 0.5 | 0.03 | 0.11 | 20.2 | 5.9 | 0.26 |
| Example Material 1 | 0.58 | 2.1 | 1.1 | 0.03 | 0.10 | 20.6 | 6.1 | 0.25 |
| Example Material 17 | 0.57 | 1.9 | 1.8 | 0.03 | 0.09 | 20.2 | 5.9 | 0.32 |
| Comparative Material 14 | 0.60 | 2.2 | 2.1 | 0.03 | 0.10 | 20.4 | 6.0 | 0.28 |

Evaluation

As shown in FIG. 7, the tensile strength decreases as the manganese content increases, and decreases markedly at a manganese content over 2%. From these results, it was verified that, in the present embodiment, a manganese content of 2.0% or less is appropriate.

Example 6

Sulfur Content

In iron-based austenitic heat-resistant cast steels, adding a large amount of sulfur facilitates heat deterioration from repeated heating and cooling, and to lower toughness. Also, sulfur combines with manganese to form MnS compounds, which enhances machinability, although this effect is inadequate below a certain sulfur content. In this embodiment, verification that a sulfur content in a range of 0.03 to 0.2% is appropriate was carried out.

Figure 8:
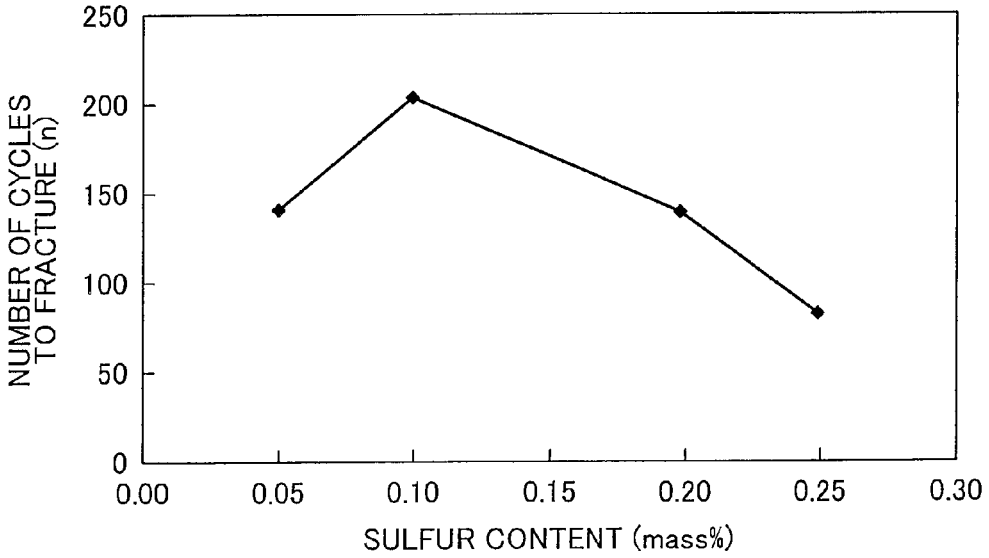
FIG. 8 is a graph showing the relationship between the sulfur content and the thermal fatigue life (number of cycles to fracture (n)) in example materials and comparative materials.

Test materials having the compositions shown in Table 7 (Example Materials 1, 2 and 4, and Comparative Example 15) were obtained by casting in the same way as in Example 1. Each of the test materials was subjected to thermal fatigue tests in the same way as in Example 1. The results are shown in FIG. 8, in which the horizontal axis represents the sulfur content and the vertical axis represents the number of cycles to fracture (n).

TABLE 7

| | C | Si | Mn | P | S | Cr | Ni | N | Cycles to fracture (n) |
|---|---|---|---|---|---|---|---|---|---|
| Example Material 1 | 0.58 | 2.1 | 1.10 | 0.03 | 0.10 | 20.6 | 6.10 | 0.25 | 206 |
| Example Material 2 | 0.60 | 2.1 | 0.50 | 0.03 | 0.05 | 19.2 | 5.10 | 0.40 | 143 |
| Example Material 4 | 0.61 | 2.1 | 0.50 | 0.03 | 0.20 | 22.0 | 5.80 | 0.40 | 142 |
| Comparative Material 15 | 0.61 | 2.0 | 1.00 | 0.03 | 0.25 | 20.0 | 6.50 | 0.25 | 82 |

Figure 9:
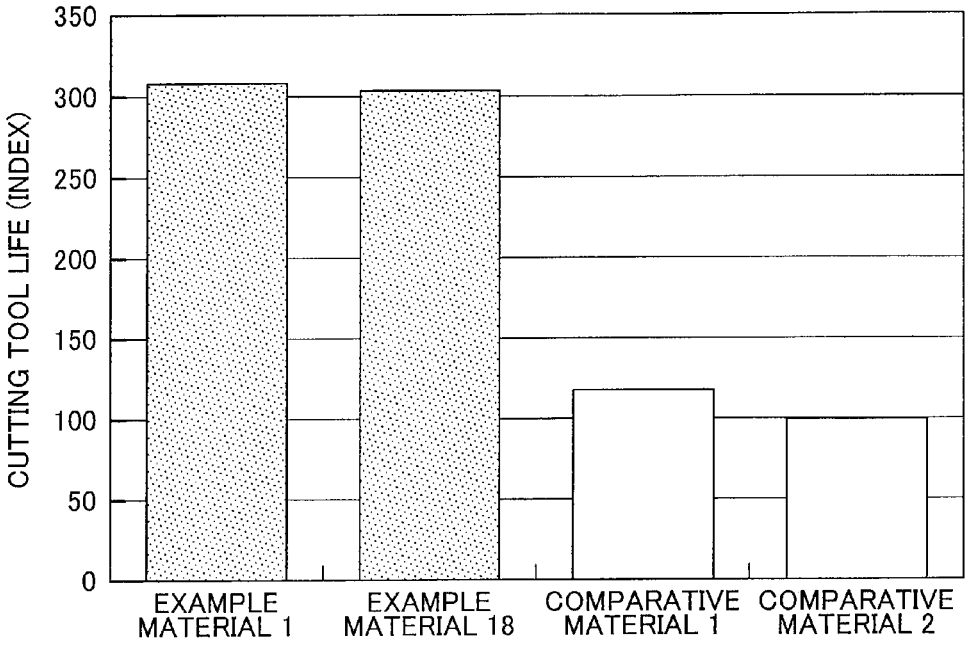
FIG. 9 is a graph showing the cutting tool life for example materials and comparative materials.

In addition, test materials having the compositions shown in Table 8 (Example Materials 1 and 18, and Comparative Examples 1 and 2) were obtained by casting in the same way as in Example 1. The machining times for each test material until 0.3 mm of cutting tool wear occurred were compared for cutting under the following conditions: machining speed, 100 m/min; feed per revolution, 0.2 mm/rev; feed, 1 mm. The life of the cutting tool when used on the respective test materials was compared based on an arbitrary value of 100 for Comparative Material 2. The results are shown in FIG. 9. In Table 8, Example Material 1 and Comparative Materials 1 and 2 were the same test materials as those used in Example 1.

TABLE 8

| | C | Si | Mn | P | S | Cr | Ni | N |
|---|---|---|---|---|---|---|---|---|
| Example Material 1 | 0.58 | 2.1 | 1.1 | 0.03 | 0.10 | 20.6 | 6.1 | 0.25 |
| Example Material 18 | 0.56 | 2.0 | 1.0 | 0.04 | 0.19 | 19.9 | 6.0 | 0.28 |
| Comparative Material 1 | 0.30 | 1.8 | 1.6 | 0.02 | 0.02 | 21.0 | 10.0 | — |
| Comparative Material 2 | 0.40 | 1.6 | 1.3 | 0.02 | 0.02 | 25.0 | 21.0 | — |

Evaluation

As shown in F. 8, it is apparent that when the sulfur content exceeds 0.2%, the thermal fatigue life markedly decreases. Moreover, as shown in FIG. 9, at a sulfur content of less than 0.03%, a large improvement in machinability is not apparent. From these results, it was verified that, in this embodiment, a sulfur content in a range of 0.03 to 0.2% is appropriate.

Example 7

Phosphorus Content

In iron-based austenitic heat-resistant cast steels, the addition of a large amount of phosphorus markedly lowers elongation. Hence, in this embodiment, verification that a phosphorus content of 0.05% or less is appropriate was carried out.

Figure 10:
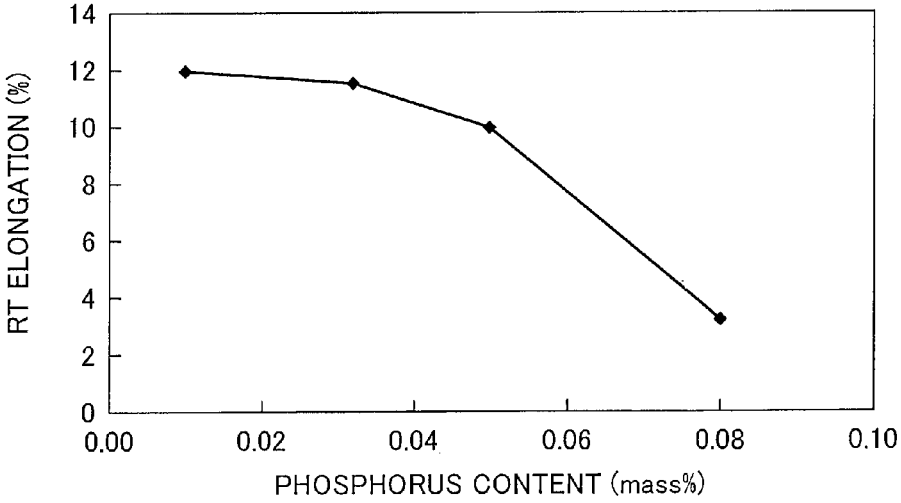
FIG. 10 is a graph showing the relationship between the phosphorus content and the elongation at room temperature in example materials and comparative examples.

Test materials having the compositions shown in Table 9 (Example Materials 1, 19 and 20, and Comparative Example 16) were obtained by casting in the same way as in Example 1. Each of the test materials was subjected to tensile tests at room temperature in general accordance with JIS Z2041. The results are shown in FIG. 10, in which the horizontal axis represents the phosphorus content and the vertical axis represents the room temperature elongation (%).

TABLE 9

| | C | Si | Mn | P | S | Cr | Ni | N |
|---|---|---|---|---|---|---|---|---|
| Example Material 1 | 0.58 | 2.1 | 1.10 | 0.03 | 0.10 | 20.6 | 6.10 | 0.25 |
| Example Material 19 | 0.61 | 2.1 | 1.00 | 0.01 | 0.11 | 20.0 | 6.20 | 0.20 |

TABLE 9-continued

| | C | Si | Mn | P | S | Cr | Ni | N |
|---|---|---|---|---|---|---|---|---|
| Example Material 20 | 0.60 | 2.1 | 1.00 | 0.05 | 0.10 | 20.3 | 6.00 | 0.22 |
| Comparative Material 16 | 0.60 | 2.0 | 1.10 | 0.08 | 0.12 | 20.1 | 6.20 | 0.20 |

Evaluation

As shown in FIG. 10, it is apparent that when the phosphorus content exceeds 0.05%, the elongation markedly decreases. From these results, it was verified that, in this embodiment, a phosphorus content in a range of 0.05% or less is appropriate.

Example 8

Chromium Content

Figure 11:
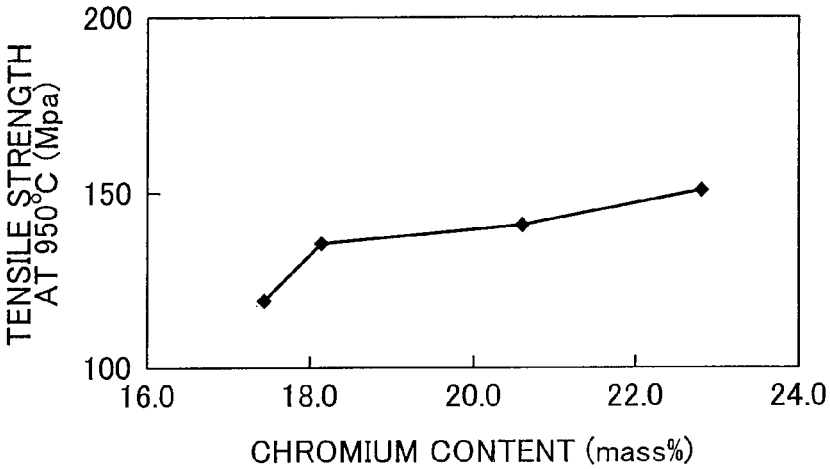
FIG. 11 is a graph showing the relationship between the chromium content and the tensile strength at 950° C. in example materials and comparative materials.
Figure 12:
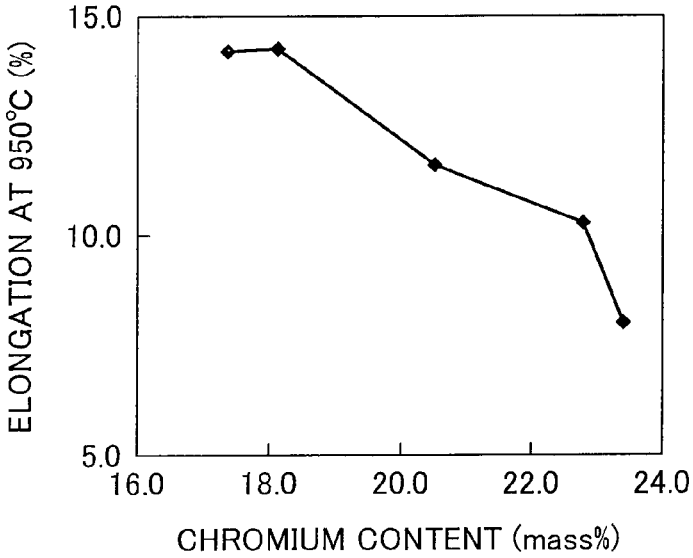
FIG. 12 is a graph showing the relationship between the chromium content and the elongation at 950° C. in example materials and comparative materials.

Verification that a chromium content in a range of 18 to 23% is appropriate in this embodiment was carried out. Test materials (Example Materials 1, 21 and 22, and Comparative Materials 17 and 18) having the compositions shown in Table 10 were obtained by casting in the same way as in Example 1. Each of the test materials was subjected to tensile testing at 950° C. in general accordance with JIS G0567. The results are shown in FIG. 11, in which the horizontal axis represents the chromium content and the vertical axis represents the elongation strength (MPa). In addition, FIG. 12 shows the chromium content on the horizontal axis versus the elongation (%) on the vertical axis. In Table 10, Example Material 1 was the same test material as that shown in Table 1.

TABLE 10

| | C | Si | Mn | P | S | Cr | Ni | N |
|---|---|---|---|---|---|---|---|---|
| Comparative Material 17 | 0.59 | 2.0 | 0.9 | 0.03 | 0.10 | 17.5 | 5.8 | 0.27 |
| Example Material 21 | 0.58 | 1.9 | 1.0 | 0.04 | 0.09 | 18.2 | 6.0 | 0.26 |
| Example Material 1 | 0.58 | 2.1 | 1.1 | 0.03 | 0.10 | 20.6 | 6.1 | 0.25 |
| Example Material 22 | 0.59 | 2.0 | 1.1 | 0.03 | 0.10 | 22.8 | 6.0 | 0.29 |
| Comparative Material 18 | 0.60 | 2.2 | 1.2 | 0.03 | 0.10 | 23.4 | 5.9 | 0.25 |

Evaluation

As shown in FIG. 11, the tensile strength decreased markedly in a test material having a chromium content of less than 18% (Comparative Material 17). This is because reducing the chromium content lowers the amount of chromium that enters into solid solution within the matrix structure. Moreover, with regard to elongation, as shown in FIG. 12, the toughness decreases with increasing chromium content, with the decrease becomes pronounced at above 23%, as in the case of Comparative Material 18. From these results, it was verified that, in the present embodiment, a chromium content in a range of 18 to 23% is appropriate.

Example 9

Nitrogen Content

In iron-based austenitic heat-resistant cast steels, nitrogen is effective for increasing the high-temperature strength, stabilizing the austenite phase, and making the microstructure finer. However, if the level of nitrogen is too low, such effects are inadequate. On the other hand, if nitrogen is added in too large an amount, the toughness decreases. Hence, in this embodiment, verification that a nitrogen content in a range of 0.05 to 0.4% is appropriate was carried out.

Figure 13:
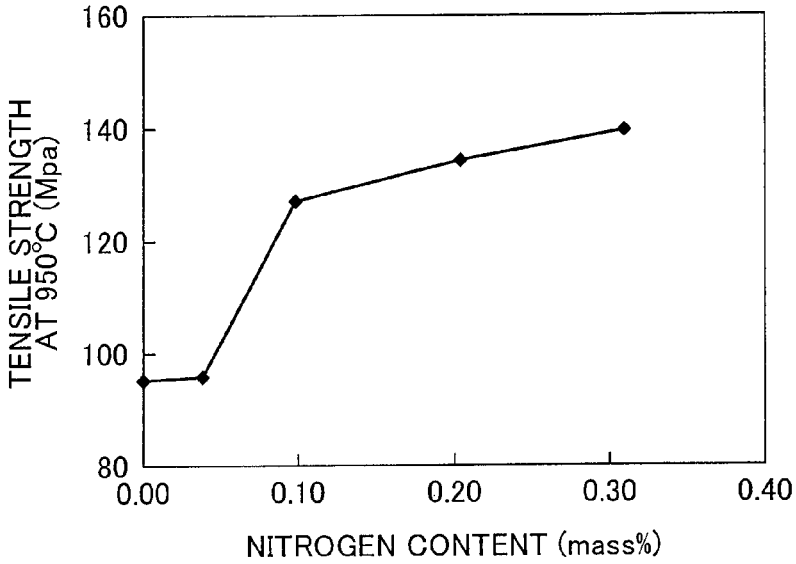
FIG. 13 is a graph showing the relationship between the nitrogen content and the tensile strength at 950° C. in example materials and comparative materials.
Figure 14:
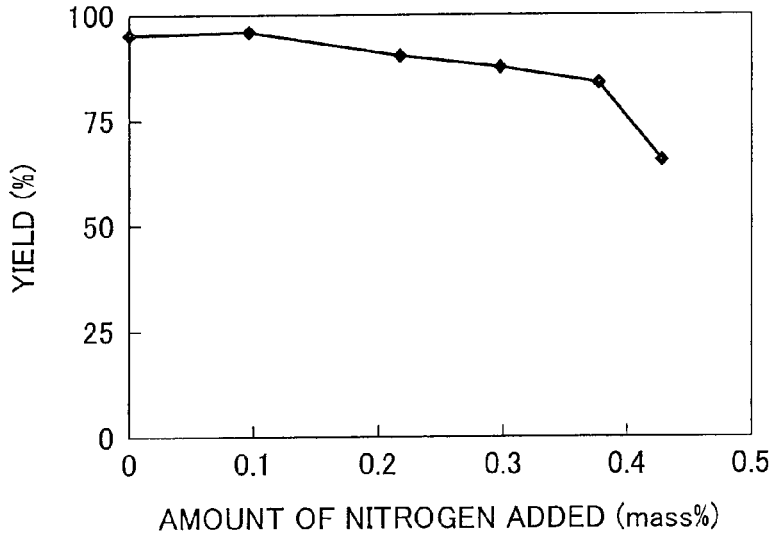
FIG. 14 is a graph showing the relationship between the nitrogen content and the yield in example materials and comparative materials.

Test materials having the compositions shown in Table 11 (Example Materials 23, 24 and 25, and Comparative Examples 19 and 20) were obtained by casting in the same way as in Example 1. Each of the test materials was subjected to a tensile test at 950° C. in general accordance with HS Z2241. The results are shown in FIG. 13, in which the horizontal axis represents the nitrogen content and the vertical axis represents the tensile strength at 950° C. (MPa). In addition, the amount of nitrogen addition and the yield were measured. Those results are shown in FIG. 14.

TABLE 11

| | C | Si | Mn | P | S | Cr | Ni | N |
|---|---|---|---|---|---|---|---|---|
| Comparative Material 19 | 0.62 | 1.8 | 1.1 | 0.03 | 0.10 | 20.5 | 6.4 | 0.00 |
| Comparative Material 20 | 0.61 | 1.8 | 1.0 | 0.03 | 0.10 | 20.0 | 6.1 | 0.04 |
| Example Material 23 | 0.60 | 2.0 | 1.2 | 0.03 | 0.09 | 20.1 | 6.0 | 0.10 |
| Example Material 24 | 0.60 | 1.9 | 1.0 | 0.03 | 0.10 | 19.6 | 5.9 | 0.20 |
| Example Material 25 | 0.59 | 1.9 | 1.0 | 0.03 | 0.09 | 20.3 | 5.9 | 0.31 |

Evaluation

As shown in FIG. 13, at a nitrogen content below 0.05%, the tensile strength markedly decreases and a high-temperature strength enhancing effect is not obtained. At above 0.1%, it is apparent that the high-temperature strength improves as the nitrogen content rises. Moreover, as shown in FIG. 14, the yield decreases with rising nitrogen content, and decreases markedly at above 0.4%. From these results, it was verified that, in the present embodiment, a nitrogen content in a range of 0.05 to 0.4% is appropriate.

Example 10

Nickel Content

In commonly used iron-based austenitic heat-resistant cast steels, at nickel contents below 13%, the high-temperature strength and austenite stabilization become inadequate. However, in the example materials, as mentioned above, by adding carbon, manganese and nitrogen in amounts calculated from the nickel equivalent ($Ni_{eq}$=Ni %+0.3 C %+0.5 Mn %+26 (N %−0.02)+2.77), an oxidation resistance and a high-temperature strength comparable to or better than those of the materials according to the related art can be obtained with the addition of nickel in a range of 3 to 8%. To verify this, additional tests were carried out on the tensile strength at 950° C.

Figure 15:
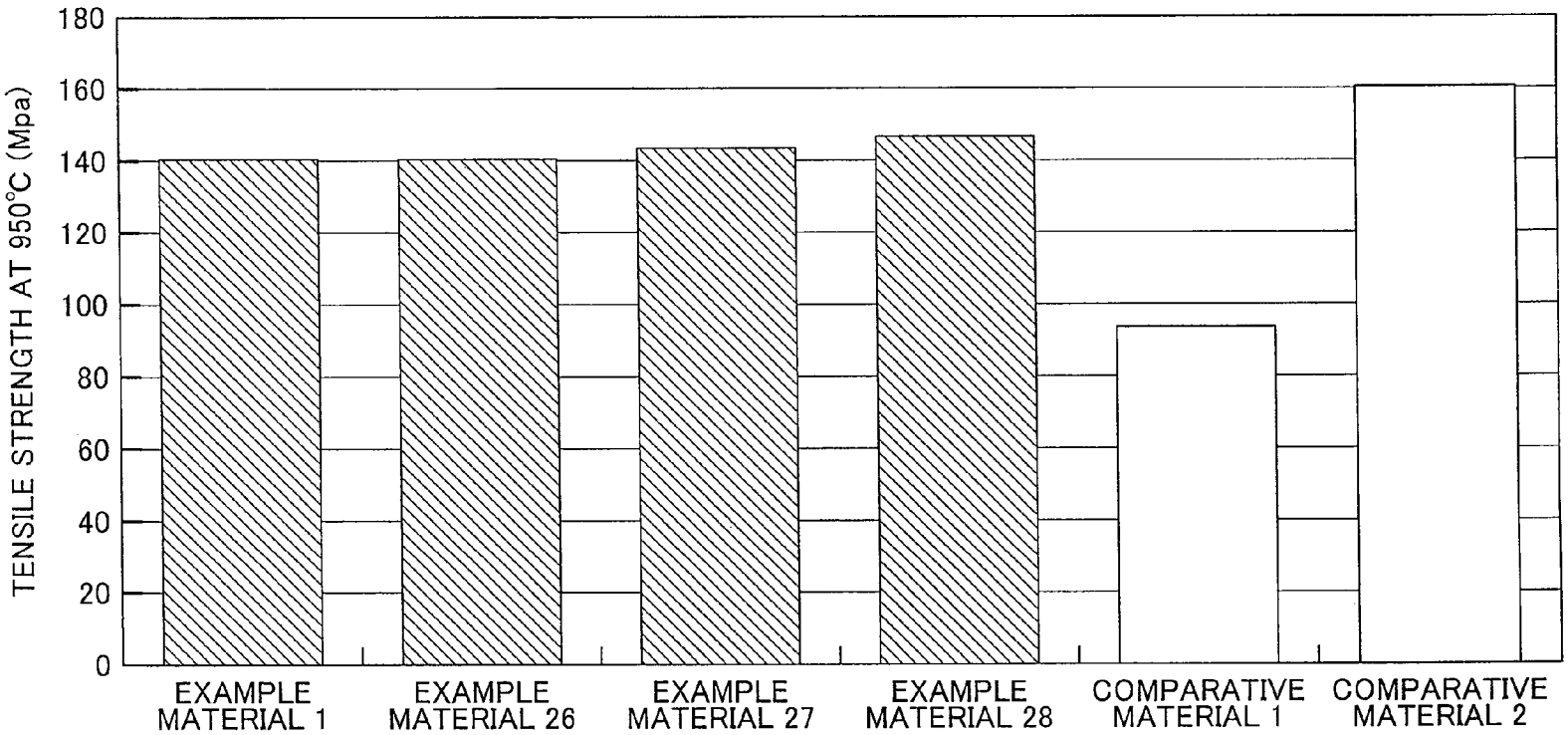
FIG. 15 is a graph showing the relationship between differences in the nickel content among example materials and comparative materials and the tensile strength at 950° C.

Test materials having the compositions shown in Table 12 (Example Materials 1 and 26 to 29, and Comparative Examples 1 and 2) were obtained by casting in the same way as in Example 1. Each of the test materials was subjected to a tensile test at 950° C. in general accordance with HS G0567. The results are shown in FIG. 15. In Table 12, Example Material 1 and Comparative Materials 1 and 2 were the same test materials as those shown in Table 1.

TABLE 12

| | C | Si | Mn | P | S | Cr | Ni | N |
|---|---|---|---|---|---|---|---|---|
| Example Material 1 | 0.58 | 2.1 | 1.1 | 0.03 | 0.10 | 20.6 | 6.1 | 0.25 |
| Example Material 26 | 0.59 | 2.1 | 1.2 | 0.03 | 0.10 | 20.6 | 6.1 | 0.24 |
| Example Material 27 | 0.60 | 1.9 | 1.0 | 0.03 | 0.09 | 20.0 | 7.0 | 0.25 |
| Example Material 28 | 0.58 | 1.9 | 1.0 | 0.03 | 0.10 | 19.8 | 7.9 | 0.26 |
| Comparative Material 1 | 0.30 | 1.8 | 1.6 | 0.02 | 0.02 | 21.0 | 10.0 | — |
| Comparative Material 2 | 0.40 | 1.6 | 1.3 | 0.02 | 0.02 | 25.0 | 21.0 | — |

Evaluation

As shown in FIG. 15, the example materials achieved higher high-temperature strengths (tensile strength at 950° C.) than Comparative Material 1, and achieved high-temperature strengths comparable to that of Comparative Material 2. This demonstrates that, in the present embodiment, by adding carbon, manganese and nitrogen in the amounts calculated from the nickel equivalent ($Ni_{eq}$=Ni %+0.3 C %+0.5 Mn %+26(N %−0.02)+2.77), an elevated high-temperature strength can be achieved with the addition of nickel in a range of 3 to 8%.

Example 11

Content of Carbide-Forming Elements (V, Mo, W, Nb)

As shown in Example 2, with the addition of carbide-forming elements (V, Mo, W, Nb), the toughness decreases, lowering the thermal fatigue characteristics under high-constraint conditions. It was thus demonstrated that, in the present embodiment, it is appropriate for the content of these elements to be less than 0.2%. The present example demonstrates that, at a content of these elements of between 0 and 0.2%, iron-based austenitic heat-resistant cast steels according to the present embodiment can be obtained which have a thermal fatigue life that fully enables their practical use.

Figure 16:
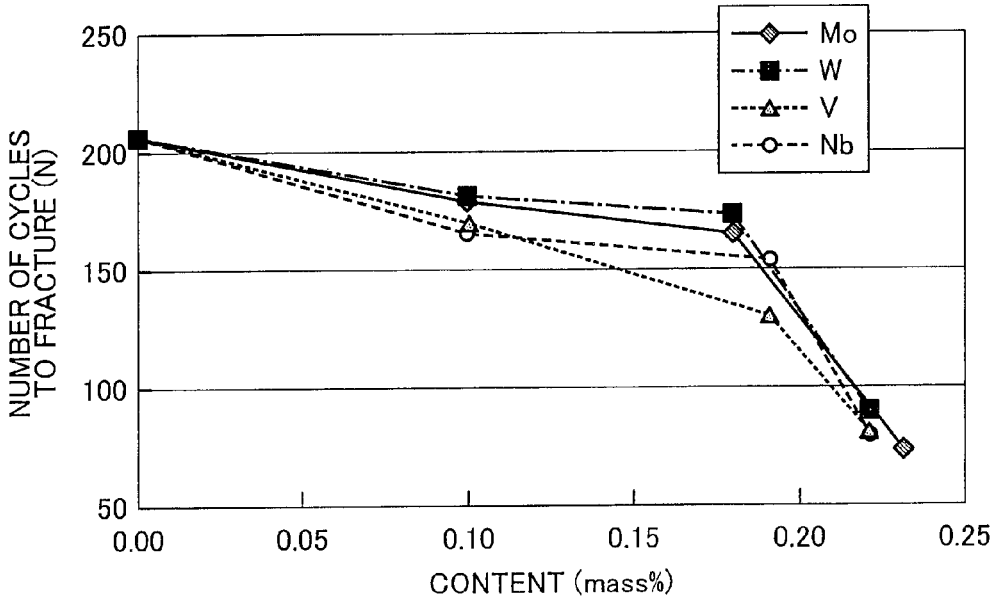
FIG. 16 is a graph showing the relationship between the content of carbide-forming elements (V, Mo, W, Nb) and the thermal fatigue life (number of cycles to fracture (n)) in example materials and comparative materials.

Test materials having the compositions shown in Table 13 (Example Materials 1 and 29 to 36, and Comparative Examples 5 to 8) were obtained by casting in the same way as in Example 1. Each of the test materials was subjected to a thermal fatigue test in the same way as in Examples 1 and 2, and the number of cycles to fracture was determined. The results are shown in FIG. 16.

In Table 13, Example Materials 28 and 29 and Comparative Material 6 are materials in which molybdenum has been added, Example Materials 30 and 31 and Comparative Example 7 are materials in which tungsten has been added, Example Materials 32 and 33 and Comparative Material 5 are materials in which vanadium has been added, and Example Materials 34 and 35 and Comparative Example 8 are materials in which niobium has been added. Also, Example Material 1 is the same test material as that shown in Table 1, and Comparative Materials 5 to 8 are the same as Comparative Materials 5 to 8 in Example 2.

TABLE 13

| | C | Si | Mn | P | S | Cr | Ni | N | Mo | W | V | Nb |
|---|---|---|---|---|---|---|---|---|---|---|---|---|
| Example Material 1 | 0.58 | 2.1 | 1.1 | 0.03 | 0.10 | 20.6 | 6.1 | 0.25 | — | — | — | — |
| Example Material 28 | 0.62 | 2.0 | 0.9 | 0.02 | 0.08 | 20.1 | 6.0 | 0.23 | 0.10 | — | — | — |
| Example Material 29 | 0.60 | 2.1 | 1.1 | 0.03 | 0.10 | 20.5 | 6.2 | 0.21 | 0.18 | — | — | — |
| Comparative Example 6 | 0.60 | 1.8 | 1.1 | 0.03 | 0.09 | 20.2 | 6.1 | 0.2 | 0.20 | — | — | — |
| Example Material 30 | 0.61 | 2.1 | 1.2 | 0.03 | 0.09 | 20.3 | 6.0 | 0.2 | — | 0.10 | — | — |
| Example Material 31 | 0.62 | 2.0 | 1.0 | 0.03 | 0.10 | 20.1 | 5.9 | 0.21 | — | 0.18 | — | — |
| Comparative Example 7 | 0.59 | 2.1 | 0.9 | 0.02 | 0.11 | 20.4 | 5.8 | 0.22 | — | 0.20 | — | — |
| Example Material 32 | 0.59 | 2.1 | 1.2 | 0.03 | 0.10 | 20.6 | 6.1 | 0.24 | — | — | 0.10 | — |
| Example Material 33 | 0.60 | 2.0 | 1.0 | 0.02 | 0.10 | 20.0 | 5.9 | 0.22 | — | — | 0.19 | — |
| Comparative Example 5 | 0.58 | 1.9 | 1.0 | 0.03 | 0.09 | 20.0 | 5.8 | 0.23 | — | — | 0.20 | — |
| Example Material 34 | 0.58 | 2.1 | 1.0 | 0.03 | 0.10 | 19.8 | 5.7 | 0.2 | — | — | — | 0.10 |
| Example Material 35 | 0.61 | 2.0 | 1.2 | 0.03 | 0.09 | 19.7 | 6.0 | 0.19 | — | — | — | 0.19 |
| Comparative Example 8 | 0.60 | 2.1 | 1.0 | 0.02 | 0.09 | 19.8 | 6.0 | 0.21 | — | — | — | 0.20 |

As shown in FIG. 16, test materials which do not contain carbide-forming elements (V, Mo, W, Nb) exhibit a large number of cycles to fracture (n). As the content increases, the number of cycles to fracture decreases, but at below 0.2%, a number of cycles to fracture that fully enables the material to be furnished for practical use is exhibited. From this example, it was also demonstrated that, in the present embodiment, even when one or two or more carbide-forming element (V, Mo, W, Nb) is included in a combined amount of less than 0.2%, austenitic heat-resistant cast steel having excellent thermal fatigue characteristics can be obtained.

While some embodiments of the invention have been illustrated above, it is to be understood that the invention is not limited to details of the illustrated embodiments, but may be embodied with various changes, modifications or improvements, which may occur to those skilled in the art, without departing from the scope of the invention.

The invention claimed is:

1. An austenitic heat-resistant cast steel including iron as a base material, comprising, based on a total of 100 mass %:

0.4 to 0.8 mass % of carbon;

3.0 mass % or less of silicon;

0.5 to 2.0 mass % of manganese;

0.05 mass % or less of phosphorus;

0.03 to 0.2 mass % of sulfur;

18 to 23 mass % of chromium;

3.0 to 8.0 mass % of nickel;

0.05 to 0.4 mass % of nitrogen; and less than 0.2 mass % of the total of a combination of vanadium, molybdenum, tungsten and niobium;

with the balance being iron and inevitable impurities;

wherein a ratio of chromium to carbon is 22.5-36.1.

2. The austenitic heat-resistant cast steel according to claim 1, wherein the combination of vanadium, molybdenum, tungsten and niobium is less than 0.2 mass % of one from among vanadium, molybdenum, tungsten and niobium.

3. The austenitic heat-resistant cast steel according to claim 1, wherein the combination of vanadium, molybdenum, tungsten and niobium is 0.19 mass % or less of one from among vanadium and niobium.

4. The austenitic heat-resistant cast steel according to claim 1, wherein the combination of vanadium, molybdenum, tungsten and niobium is 0.18 mass % or less of one from among molybdenum and tungsten.

* * * * *